US006140569A

United States Patent [19]

Tsai

[11] Patent Number: 6,140,569

[45] Date of Patent: Oct. 31, 2000

[54] MEMORY REDUCTION METHOD AND APPARATUS FOR VARIABLE FREQUENCY DIVIDERS

[75] Inventor: Wen-Hao Tsai, Hsinchu, Taiwan

[73] Assignee: Winbond Electronics Corp., Hsinchu, Taiwan

[21] Appl. No.: 09/189,636

[22] Filed: Nov. 10, 1998

[51] Int. Cl.[7] ..... G10H 5/06

[52] U.S. Cl. ..... 84/648; 84/675

[58] Field of Search ..... 84/648, 675

[56] References Cited

U.S. PATENT DOCUMENTS 4,522,099 6/1985 Melsheimer ..... 84/648 X 4,537,108 8/1985 Shiramizu .

4,805,508 2/1989 Isozaki .

5,426,260 6/1995 Terashima et al. .

*Primary Examiner*—Jeffrey Donels

*Attorney, Agent, or Firm*—Finnegan, Henderson, Farabow, Garrett & Dunner, L.L.P.

[57] ABSTRACT

Method and apparatus reduce the memory capacity needed to store control codes used to obtain specified frequency values that represent musical tones with a predetermined relationship. The predetermined relationship of the musical tones allows a dual-tone melody generating music box to play melodies two notes at a time. A six-bit code is used to instruct a frequency divider how to divide a master frequency into each desired musical tone.

23 Claims, 3 Drawing Sheets

MEMORY REDUCTION METHOD AND APPARATUS FOR VARIABLE FREQUENCY DIVIDERS

BACKGROUND OF THE INVENTION

The present invention relates generally to variable frequency dividers, and more particularly, to methods and apparatus for reducing the memory capacity needed to store control codes used to obtain specified frequency values.

Conventional music boxes rely on variable frequency dividers to generate melodies. To store melody information, however, these music boxes often require a large memory. If these music boxes use a dual-tone melody generator, the amount of memory needed to store melody information increases significantly.

FIG. 1 shows a block diagram of a conventional music box 100 which includes an oscillation circuit 110, a frequency divider 120, a melody read-only memory (ROM) 130, a rhythm control circuit 140, an envelope generator 150, a control logic 160, an address generator 170, a digital-to-analog converter (DAC) 180, and a speaker 190. Oscillation circuit 110 generates a high-frequency pulse signal. Frequency divider 120 receives and divides the high frequency pulse signal into a melody note pitch tone according to output data from melody ROM 130. Melody ROM 130 contains pitch, tempo and rhythm information for generating a melody. Rhythm control circuit 140 controls the envelope, generated by envelope generator 150, and the duration of a melody. A melody output signal is generated through DAC 180 and sent to speaker 190. The frequency divider output signal determines the speaker output frequency and the output value of the envelope generator determines the amplitude.

In the conventional music box of FIG. 1, melody ROM 130 contains all of the melody information. Consequently, melody ROM 130 must be large enough to store all of the melody information. A typical dual-tone melody music box requires a 50 kHz oscillation circuit to generate a high frequency pulse signal. Melody ROM 130 stores an eight bit integer number to divide the high frequency signal into an actual sound pitch tone. Since each pitch tone requires storing eight bits of data, a total of 16 bits of data is needed for a dual-tone melody generator. Moreover, three bits of data storage are needed to control up to eight different rhythms generated by rhythm control circuit 140 and two bits of data storage are needed to control envelope generator 150. Therefore, a 21-bit memory width is required for a typical dual-tone music generator. Of the required 21 bit memory width, more than 70 percent is needed to store frequency divider information.

U.S. Pat. No. 4,537,108 to Shiramizu discloses an electronic musical instrument with two variable frequency dividers. The instrument includes a code generator for generating a first code indicating a tone pitch and a second code indicating an octave. The first variable frequency divider is presettable to a first count value as a function of the first code for counting master clock pulses supplied from an oscillator and generating a first divider output when the first count value is reached. The second variable frequency divider is presettable to a second count value as a function of the second code for counting the first divider output and generating a plurality of pulse trains with an octave frequency relationship. While Shiramizu teaches an instrument that generates codes corresponding to pitch tones, it further teaches storing pitch tone data in a ROM as a nine-bit value. Thus, similar to the music box of FIG. 1, the instrument of Shiramnizu requires a significant amount of memory to store pitch tone data and melody information.

In view of the foregoing, there is a need for methods and apparatus that minimize the required memory for frequency division information storage in music boxes and other devices.

SUMMARY OF THE INVENTION

Methods and apparatus consistent with the present invention meet these desires by reducing the memory capacity needed to store control codes used to obtain specified frequency values.

A method for performing frequency division to obtain specified frequency values comprises specifying a plurality of secondary frequency values with a predetermined relationship; creating an instruction code for dividing a master frequency into the plurality of secondary frequency values; and storing the instruction code in a memory.

An apparatus that performs frequency division to obtain specified frequency values comprises means for specifying a plurality of secondary frequency values with a predetermined relationship; means for creating an instruction code for dividing a master frequency into the plurality of secondary frequency values; and means for storing the instruction code in a memory.

Both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of the specification, illustrate presently preferred embodiments of the invention and, together with the preceding general description and the following detailed description, explain the principles of the invention.

In the drawings.

DETAILED DESCRIPTION OF THE INVENTION

Methods and apparatus consistent with the present invention reduce the memory capacity needed to store control codes used to obtained specified frequency values. For example, instead of storing conventional eight-bit integer data representing a specific frequency value, the methods and apparatus consistent with the present invention store a six-bit control code used to generate the desired frequency value. When applied to music box technology, the six-bit control code generates a basic divider value and an operation of the basic divider value for obtaining specific pitch tones. Correction logic is also used to more accurately represent ideal pitch tones. While the following detailed description applies methods and apparatus consistent with the present invention to music box technology, one skilled in the art will appreciate that the following description may apply to any technology utilizing variable frequency dividers.

Figure 1:
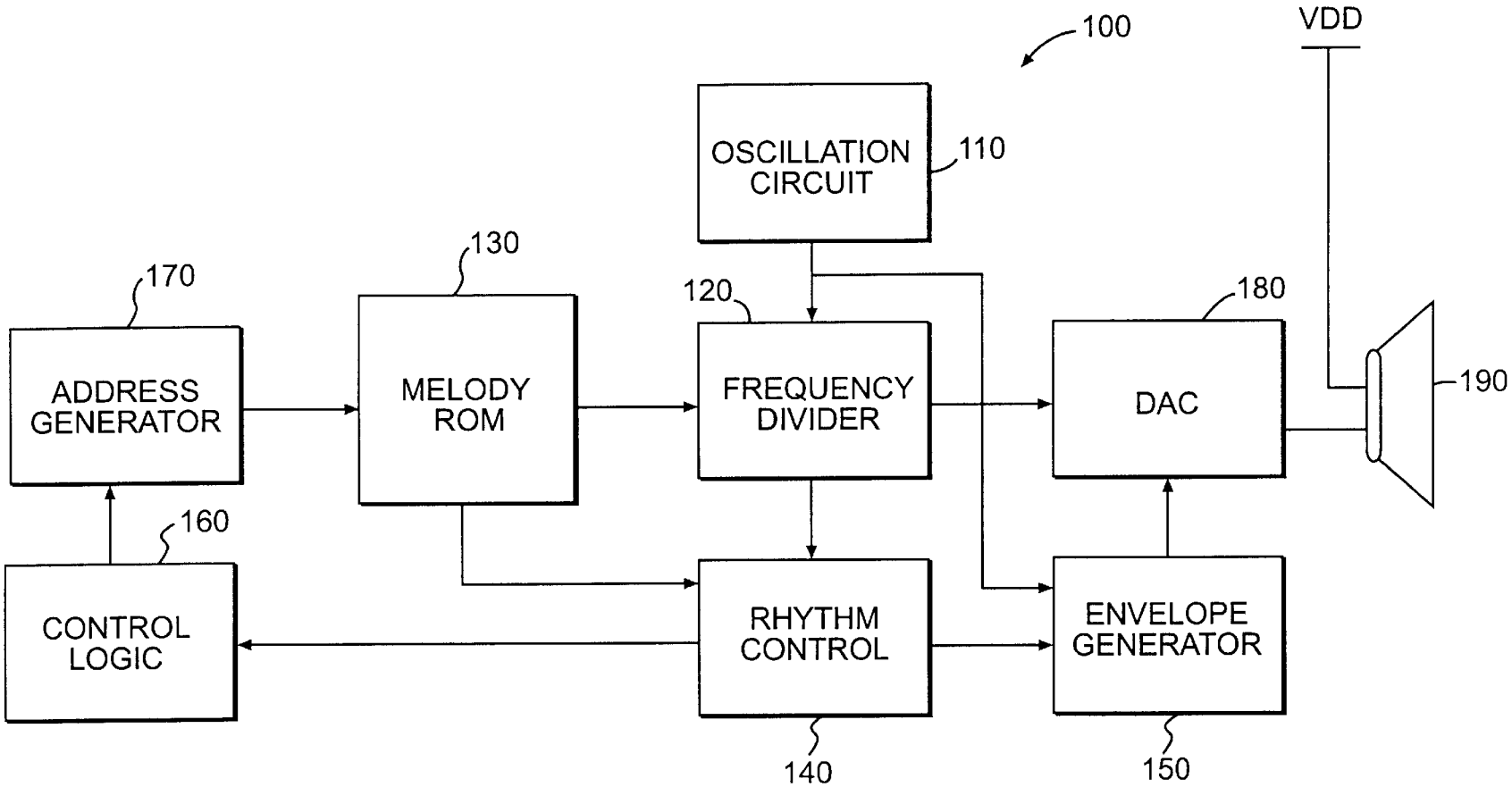
FIG. 1 is a block diagram of a conventional music box.
Figure 2:
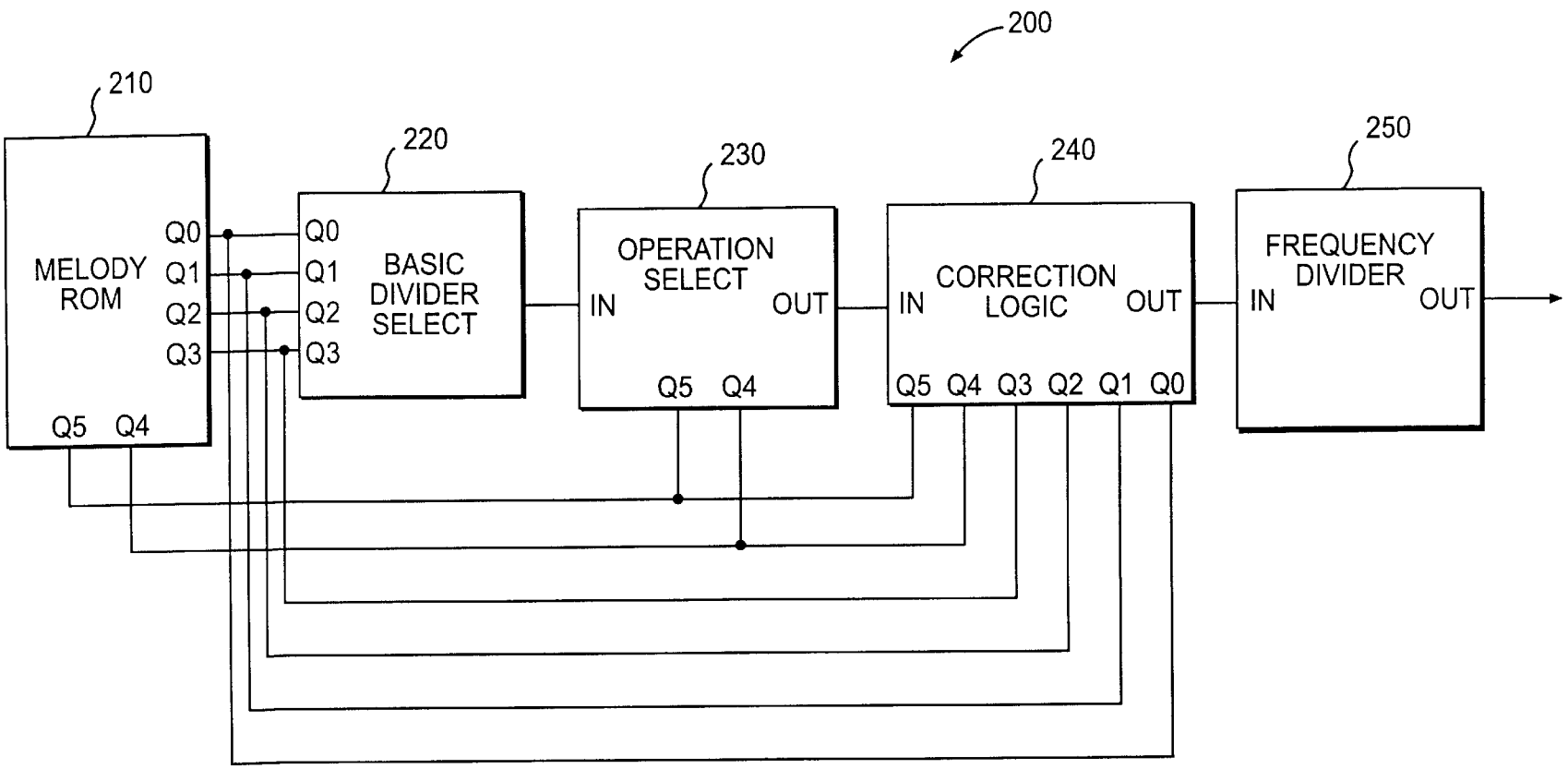
FIG. 2 is a block diagram of a circuit that implements a frequency divider method consistent with the present invention.

FIG. 2 is a block diagram of a circuit 200 that implements a frequency divider method consistent with the present invention. Circuit 200 includes a melody ROM 210, a basic divider select device 220, an operation select device 230, a correction logic device 240, and a frequency divider 250.

Melody ROM 210 stores control codes used to generate desired frequency values. A method for obtaining these control codes is provided in further detail below. Basic divider select device 220 selects basic frequency divider values for obtaining desired pitch tones. Operation select device 230 applies a mathematical operation to one or more of the basic frequency divider values (e.g., basic divider value times two). Correction logic device 240 generates integer values that may be mathematically combined with the basic frequency value generated by basic divider select device 220 and the operation of the basic frequency divider value generated by the operation select device. The correction logic values allow a generated frequency value to more accurately represent an ideal frequency. The combined basic divider value, operation on the basic divider value, and control logic value are sent to frequency divider 250 to generate each pitch tone. Using this information, frequency divider 250 divides a master clock frequency (e.g., 50 kHz frequency) to yield the desired pitch tone.

In a music box, circuit 200 can be used to generate a myriad of melodies using less memory space than conventional music boxes. For example, if music box sound pitch ranges from G#3 to C7, then the ideal pitch frequencies range from 207.65 Hz to 2093 Hz. Typically, a frequency divider divides a 50 kHz high frequency pulse into the desired sound pitch frequency. This division is illustrated in Table 1, which shows an ideal sound frequency and the generated frequency. As shown in Table 1, if a tone signal having frequency close to 207.65 Hz is desired, the 50 kHz high frequency pulse can be divided by 241 to yield a 207.47 Hz signal. In conventional music boxes, eight-bits of memory space is needed to store the frequency divider information for each tone. Therefore, a total of 16-bits of data is needed for a conventional dual-tone melody generator. This conventional scheme is detailed in Table 1 below.

TABLE 1

| Number | Pitch | Generated Frequency | Ideal Frequency | Frequency Divider | 8 Bits Code |
|---|---|---|---|---|---|
| 1 | G#3 | 207.47 | 207.65 | 241 | F1 |
| 2 | A3 | 220.26 | 220.00 | 227 | E3 |
| 3 | A#3 | 233.64 | 233.08 | 214 | D6 |
| 4 | B3 | 246.31 | 246.94 | 203 | CB |
| 5 | C4 | 261.78 | 261.63 | 191 | BF |
| 6 | C#4 | 277.78 | 277.18 | 180 | B4 |
| 7 | D4 | 294.12 | 293.67 | 170 | AA |
| 8 | D#4 | 310.56 | 311.13 | 161 | A1 |
| 9 | E4 | 328.95 | 329.63 | 152 | 98 |
| 10 | F4 | 349.65 | 349.23 | 143 | 8F |
| 11 | F#4 | 370.37 | 370.00 | 135 | 87 |
| 12 | G4 | 390.63 | 392.00 | 128 | 80 |
| 13 | G#4 | 416.67 | 415.31 | 120 | 78 |
| 14 | A4 | 438.60 | 440.00 | 114 | 72 |
| 15 | A#4 | 467.29 | 466.16 | 107 | 6B |
| 16 | B4 | 495.05 | 493.88 | 101 | 65 |
| 17 | C5 | 520.83 | 523.25 | 96 | 60 |
| 18 | C#5 | 555.56 | 554.37 | 90 | 5A |
| 19 | D5 | 588.24 | 587.33 | 85 | 55 |
| 20 | D#5 | 625.00 | 622.25 | 80 | 50 |
| 21 | E5 | 657.89 | 659.26 | 76 | 4C |
| 22 | F5 | 694.44 | 698.46 | 72 | 48 |
| 23 | F#5 | 735.29 | 739.99 | 68 | 44 |
| 24 | G5 | 781.25 | 783.99 | 64 | 40 |
| 25 | G#5 | 833.33 | 830.61 | 60 | 3C |
| 26 | A5 | 877.19 | 880.00 | 57 | 39 |
| 27 | A#5 | 925.93 | 932.33 | 54 | 36 |
| 28 | B5 | 980.39 | 987.77 | 51 | 33 |

TABLE 1-continued

| Number | Pitch | Generated Frequency | Ideal Frequency | Frequency Divider | 8 Bits Code |
|---|---|---|---|---|---|
| 29 | C6 | 1041.67 | 1046.50 | 48 | 30 |
| 30 | C#6 | 1111.11 | 1108.73 | 45 | 2D |
| 31 | D6 | 1162.79 | 1174.66 | 43 | 2B |
| 32 | D#6 | 1250.00 | 1244.51 | 40 | 28 |
| 33 | E6 | 1315.79 | 1318.51 | 38 | 26 |
| 34 | F6 | 1388.89 | 1396.91 | 36 | 24 |
| 35 | F#6 | 1470.59 | 1479.98 | 34 | 22 |
| 36 | G6 | 1562.50 | 1567.98 | 32 | 20 |
| 37 | G#6 | 1666.67 | 1661.22 | 30 | 1E |
| 38 | A6 | 1785.71 | 1760.00 | 28 | 1C |
| 39 | A#6 | 1851.85 | 1864.65 | 27 | 1B |
| 40 | B6 | 2000.00 | 1975.53 | 25 | 19 |
| 41 | C7 | 2083.33 | 2093.00 | 24 | 18 |

With circuit 200 of FIG. 2, the frequency divider values in the fifth column of Table 1 are generated using basic divider select device 220, operation select device 230 and correction logic device 240. A six-bit control code stored in melody ROM 210 determines how the frequency divider values are generated. This determination is based on the relationship of values generated by the components of circuit 200, described in further detail below.

As illustrated Table 1, there is an approximate two-times frequency relationship between tow-octave ideal frequencies. For example, as shown in Table 1, the ideal frequency of 415.31 Hz for the G#4 pitch (No. 13) is approximately twice the ideal frequency of 207.65 Hz for the G#3 (No. 1). In addition, an approximate two-times relationship exists for the frequency divider. For example, the frequency divider value of 241 for the G#3 pitch in Table 1 is twice the frequency divider value of 120 for the G#4 pitch. Thus, basic frequency divider values may be defined based on the two-times relationship between octaves of ideal frequencies. To demonstrate this feature, assume basic divider select device 220 generates twelve values (one for each pitch within an octave): 64, 68, 72, 76, 80, 85, 90, 96, 101, 107, 114, and 120. Using these values, the frequency divider value in Table 1 can be derived by multiplying or dividing one of these twelve values by 1, 2 or 4 (these operations determined by operation select circuit 230) with an offset by +1 or −1 (these values determined by correction logic device 240). One skilled in the art will now appreciate that any number or combinations of basic divider values, operations, and control logic values may be used in the embodiments described herein. As an example, Table 2 illustrates the relationship of values generated by circuit 200 to determine a frequency divider value for each pitch.

TABLE 2

| Number | Pitch | Generated Frequency | Ideal Frequency | Frequency Divider | 6 Bits Code |
|---|---|---|---|---|---|
| 1 | G#3 | 207.47 | 207.65 | 120*2 + 1 | 000000 |
| 2 | A3 | 220.26 | 220.00 | 114*2 − 1 | 000001 |
| 3 | A#3 | 233.64 | 233.08 | 107*2 | 000010 |
| 4 | B3 | 246.31 | 246.94 | 101*2 + 1 | 000011 |
| 5 | C4 | 261.78 | 261.63 | 96*2 + 1 | 000100 |
| 6 | C#4 | 277.78 | 277.78 | 90*2 | 000101 |
| 7 | D4 | 294.12 | 293.67 | 85*2 | 000110 |
| 8 | D#4 | 310.56 | 311.13 | 80*2 + 1 | 000111 |
| 9 | E4 | 328.95 | 329.63 | 76*2 | 001000 |
| 10 | F4 | 349.65 | 349.23 | 72*2 − 1 | 001001 |
| 11 | F#4 | 370.37 | 370.00 | 68*2 − 1 | 001010 |
| 12 | G4 | 390.63 | 392.00 | 64*2 | 001011 |
| 13 | G#4 | 416.67 | 415.31 | 120 | 010000 |

TABLE 2-continued

| Number | Pitch | Generated Frequency | Ideal Frequency | Frequency Divider | 6 Bits Code |
|---|---|---|---|---|---|
| 14 | A4 | 438.60 | 440.00 | 114 | 010001 |
| 15 | A#4 | 467.29 | 466.16 | 107 | 010010 |
| 16 | B4 | 495.05 | 493.88 | 101 | 010011 |
| 17 | C5 | 520.83 | 523.25 | 96 | 010100 |
| 18 | C#5 | 555.56 | 554.37 | 90 | 010101 |
| 19 | D5 | 588.24 | 587.33 | 85 | 010110 |
| 20 | D#5 | 625.00 | 622.25 | 80 | 010111 |
| 21 | E5 | 657.89 | 659.26 | 76 | 011000 |
| 22 | F5 | 694.44 | 698.46 | 72 | 011001 |
| 23 | F#5 | 735.29 | 739.99 | 68 | 011010 |
| 24 | G5 | 781.25 | 783.99 | 64 | 011011 |
| 25 | G#5 | 833.33 | 830.61 | 120/2 | 100000 |
| 26 | A5 | 877.19 | 880.00 | 114/2 | 100001 |
| 27 | A#5 | 925.93 | 932.33 | 107/2 + 1 | 100010 |
| 28 | B5 | 980.39 | 987.77 | 101/2 + 1 | 100011 |
| 29 | C6 | 1041.67 | 1046.50 | 96/2 | 100100 |
| 30 | C#6 | 1111.11 | 1108.73 | 90/2 | 100101 |
| 31 | D6 | 1162.79 | 1174.66 | 85/2 + 1 | 100110 |
| 32 | D#6 | 1250.00 | 1244.51 | 80/2 | 100111 |
| 33 | E6 | 1315.79 | 1318.51 | 76/2 | 101000 |
| 34 | F6 | 1388.89 | 1396.91 | 72/2 | 101001 |
| 35 | F#6 | 1470.59 | 1479.98 | 68/2 | 101010 |
| 36 | G6 | 1562.50 | 1567.98 | 64/2 | 101011 |
| 37 | G#6 | 1666.67 | 1661.22 | 120/4 | 110000 |
| 38 | A6 | 1785.71 | 1760.00 | 114/4 | 110001 |
| 39 | A#6 | 1851.85 | 1864.65 | 107/4 + 1 | 110010 |
| 40 | B6 | 2000.00 | 1975.53 | 101/4 | 110011 |
| 41 | C7 | 2083.33 | 2093.00 | 96/4 | 110100 |

Once the basic frequency divider values and the operation of the basic frequency divider values are determined, the six-bit control code for generating any frequency divider value in Table 2 from the twelve basic frequency divider values can be determined. With twelve basic divider values, four-bits may be used to select each basic divider value. Similarly, with four possible basic divider value operations (i.e., *2, * 1, /2, and /4), two bits may be used to select the appropriate operation. Thus, as illustrated in the sixth column of Table 2, a six-bit control code may be stored in melody ROM 210 to determine a frequency divider for each pitch. The most significant two-bits of the six-bit control code select the operation, while the least significant four-bits select the basic divider value. This feature of circuit 200 eliminates the need to store an eight-bit number in melody ROM, as found in conventional music boxes.

The basic divider values generated by basic divider select device 220 of FIG. 2 are determined using a truth table similar to that illustrated in Table 3 below. Each input of basic divider select device 220 (i.e., Q0, Q1, Q2, and Q3) receives one-bit of information from melody ROM 210. Depending on the information received (i.e., 0 or 1), basic divider select device 220 determines the appropriate basic divider value.

TABLE 3

| Q3 | Q2 | Q1 | Q0 | OUT |
|---|---|---|---|---|
| 0 | 0 | 0 | 0 | 120 |
| 0 | 0 | 0 | 1 | 114 |
| 0 | 0 | 1 | 0 | 107 |
| 0 | 0 | 1 | 1 | 101 |
| 0 | 1 | 0 | 0 | 96 |
| 0 | 1 | 0 | 1 | 90 |
| 0 | 1 | 1 | 0 | 85 |
| 0 | 1 | 1 | 1 | 80 |
| 1 | 0 | 0 | 0 | 76 |
| 1 | 0 | 0 | 1 | 72 |

TABLE 3-continued

| Q3 | Q2 | Q1 | Q0 | OUT |
|---|---|---|---|---|
| 1 | 0 | 1 | 0 | 68 |
| 1 | 0 | 1 | 1 | 64 |

After generating the basic divider value, basic divider select device 220 sends it to operation select device 230, which also receives a two-bit control code from melody ROM 210. As illustrated in Table 4 below, if the control code is "00," operation select device 230 outputs the incoming basic divider value multiplied by two. If the control code is "01," operation select device 230 outputs the incoming basic divider value unchanged. If the control code is "10," operation select device 230 outputs the incoming basic divider value divided by two. Finally, if the control code is "11," operation select device 230 outputs the incoming basic divider value divided by four.

TABLE 4

| Q5 | Q4 | OUT |
|---|---|---|
| 0 | 0 | IN*2 |
| 0 | 1 | IN |
| 1 | 0 | IN/2 |
| 1 | 1 | IN/4 |

Correction logic device 240 receives the output of operation select device 230 along with the output (Q0–Q5) of melody ROM 210. Correction logic device 240 determines whether the output of operation select device 230 needs correction before being forwarded to frequency divider 250. This determination is based on the output values of melody ROM 210 as illustrated in Table 5 below.

TABLE 5

| Q5 | Q4 | Q3 | Q2 | Q1 | Q0 | OUT |
|---|---|---|---|---|---|---|
| 0 | 0 | 0 | 0 | 0 | 0 | IN + 1 |
| 0 | 0 | 0 | 0 | 0 | 1 | IN − 1 |
| 0 | 0 | 0 | 0 | 1 | 0 | IN |
| 0 | 0 | 0 | 0 | 1 | 1 | IN + 1 |
| 0 | 0 | 0 | 1 | 0 | 0 | IN − 1 |
| 0 | 0 | 0 | 1 | 0 | 1 | IN |
| 0 | 0 | 0 | 1 | 1 | 0 | IN |
| 0 | 0 | 0 | 1 | 1 | 1 | IN + 1 |
| 0 | 0 | 1 | 0 | 0 | 0 | IN |
| 0 | 0 | 1 | 0 | 0 | 1 | IN − 1 |
| 0 | 0 | 1 | 0 | 1 | 0 | IN − 1 |
| 0 | 0 | 1 | 0 | 1 | 1 | IN |
| 0 | 1 | 0 | 0 | 0 | 0 | IN |
| 0 | 1 | 0 | 0 | 0 | 1 | IN |
| 0 | 1 | 0 | 0 | 1 | 0 | IN |
| 0 | 1 | 0 | 0 | 1 | 1 | IN |
| 0 | 1 | 0 | 1 | 0 | 0 | IN |
| 0 | 1 | 0 | 1 | 0 | 1 | IN |
| 0 | 1 | 0 | 1 | 1 | 0 | IN |
| 0 | 1 | 0 | 1 | 1 | 1 | IN |
| 0 | 1 | 1 | 0 | 0 | 0 | IN |
| 0 | 1 | 1 | 0 | 0 | 1 | IN |
| 0 | 1 | 1 | 0 | 1 | 0 | IN |
| 0 | 1 | 1 | 0 | 1 | 1 | IN |
| 1 | 0 | 0 | 0 | 0 | 0 | IN |
| 1 | 0 | 0 | 0 | 0 | 1 | IN |
| 1 | 0 | 0 | 0 | 1 | 0 | IN + 1 |
| 1 | 0 | 0 | 0 | 1 | 1 | IN + 1 |
| 1 | 0 | 0 | 1 | 0 | 0 | IN |
| 1 | 0 | 0 | 1 | 0 | 1 | IN |
| 1 | 0 | 0 | 1 | 1 | 0 | IN + 1 |
| 1 | 0 | 0 | 1 | 1 | 1 | IN |

TABLE 5-continued

| Q5 | Q4 | Q3 | Q2 | Q1 | Q0 | OUT |
|---|---|---|---|---|---|---|
| 1 | 0 | 1 | 0 | 0 | 0 | IN |
| 1 | 0 | 1 | 0 | 0 | 1 | IN |
| 1 | 0 | 1 | 0 | 1 | 0 | IN |
| 1 | 0 | 1 | 0 | 1 | 1 | IN |
| 1 | 1 | 0 | 0 | 0 | 0 | IN |
| 1 | 1 | 0 | 0 | 0 | 1 | IN |
| 1 | 1 | 0 | 0 | 1 | 0 | IN + 1 |
| 1 | 1 | 0 | 0 | 1 | 1 | IN |
| 1 | 1 | 0 | 1 | 0 | 0 | IN |

With circuit 200 of FIG. 2, a melody ROM with only a 17-bit width is needed to store dual-tone melody information. As compared to a conventional 21-bit width memory, circuit 200 allows for a melody ROM that is four-bits smaller in width, resulting in a 19 percent reduction in the memory size. This reduction is extremely important if a large melody ROM is required. Utilizing basic divider select, operation select, and correction logic devices allows for the reduced memory size. Table 6 shows a transistor count for the basic divider select, operation select, and correction logic devices of circuit 200. Table 7 shows a comparison of transistor counts between conventional music box circuits and circuit 200. Because of different memory implementation methods, only the memory cells are considered in Table 7. Moreover, the address decoder transistor counts are not considered since both will be the same.

TABLE 6

| | Transistor Count |
|---|---|
| Basic Divider Select | 112 |
| Operation Select | 116 |
| Correction Logic | 616 |
| Total Extra Overhead | 844 |

TABLE 7

| | Conventional | Proposed | Reduction Ratio |
|---|---|---|---|
| 1 K Note ROM | 21 K | 17 K + 844 | 15% |
| 2 K Note ROM | 42 K | 34 K + 844 | 17% |
| 4 K Note ROM | 84 K | 68 K + 844 | 18% |

Figure 3:
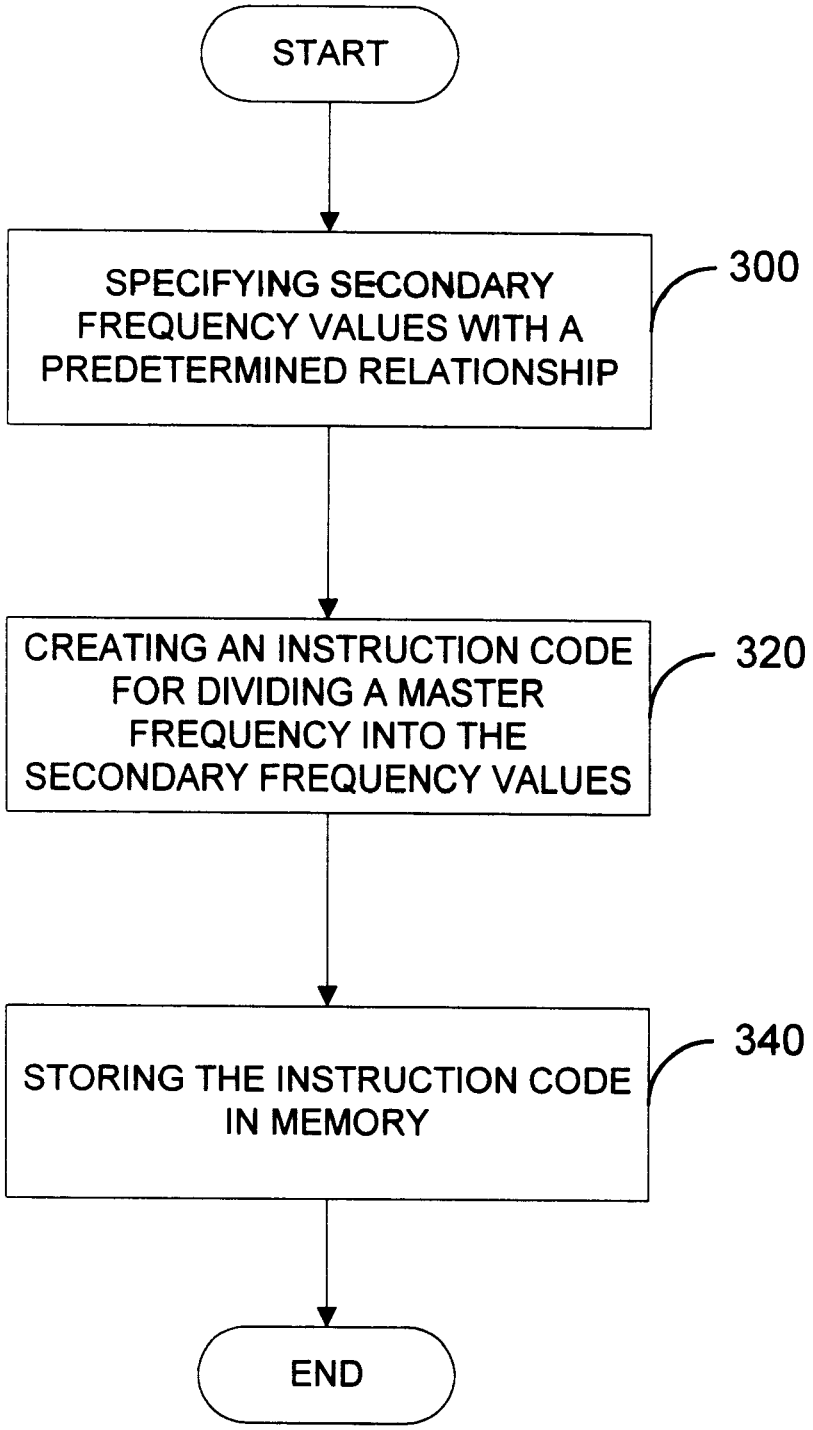
FIG. 3 is a flowchart of a frequency divider method consistent with the present invention.

FIG. 3 is a flowchart of a frequency divider method consistent with the present invention. The method begins with specifying secondary frequency values with a predetermined relationship (step 300). The secondary frequency values are generated by the basic divider values, an operation on the basic divider values, and any correction logic values. Once these values are specified, instruction codes are created for dividing a master frequency into each of the secondary frequency values (step 320). The instruction code is then stored in a memory ROM and subsequently implemented to generate desired pitch tones and melodies (step 340).

The foregoing method and apparatus minimize the required memory for frequency division information storage in music boxes and other devices. Instead of storing conventional integer data, e.g., eight-bit data, representing a specific frequency value, methods and apparatus consistent with the present invention store a control code of fewer bits, e.g., six bits, used to generate the desired frequency value. When applied to music box technology, the six-bit control code is used to generate a divider value for a specific pitch tone. Correction logic is also used to generate a frequency value that is virtually identical to any desired frequency value.

While only some embodiments and methods consistent with the present invention have been described, those skilled in the art will understand that various changes and modifications may be made to these embodiments, and equivalents may be substituted for elements in these embodiments, without departing from the true scope of the invention.

In addition, many modifications may be made to adapt a particular element, technique or implementation to the teachings of the present invention without departing from the central scope of the invention. Therefore, this invention should not be limited to the particular embodiments and methods disclosed herein, but should include all embodiments falling within the scope of the appended claims.

What is claimed is:

1. A method of dividing frequency, comprising:

specifying a plurality of secondary frequency values with a predetermined relationship;

creating an instruction code for dividing a master frequency into the plurality of secondary frequency values, the instruction code generating at least one basic divider value;

storing the instruction code in a memory; and dividing the master frequency into the plurality of secondary frequency values.

2. The method of claim 1 wherein specifying includes specifying a plurality of tones to form a melody.

3. The method of claim 1 wherein specifying includes specifying basic divide counts for the specified frequencies.

4. The method of claim 3 further comprising performing multiplying/dividing operations for each of the basic divide counts.

5. The method of claim 1 wherein creating includes creating a six-bit instruction code.

6. A method of dividing frequency, comprising:

specifying a plurality of secondary frequency values with a predetermined relationship;

creating an instruction code for dividing a master frequency into the plurality of secondary frequency values, the instruction code generating at least one basic divider value, wherein creating includes creating a six-bit instruction code:

storing the instruction code in a memory; and dividing the master frequency into the plurality of secondary frequency values.

7. A method of dividing frequency, comprising:

specifying a plurality of secondary frequency values with a predetermined relationship;

creating an instruction code for dividing a master frequency into the plurality of secondary frequency values, the instruction code generating at least one basic divider value, wherein creating further includes selectively generating an operation on the basic divider value as a function of one of the specified secondary frequency values to be obtained;

storing the instruction code in a memory; and dividing the master frequency into the plurality of secondary frequency values.

8. The method of claim 1 wherein storing includes storing the instruction code in a read-only memory.

9. A method of dividing frequency, comprising:

specifying a plurality of secondary frequency values with a predetermined relationship;

creating an instruction code for dividing a master frequency into the plurality of secondary frequency values, the instruction code generating at least one basic divider value;

storing the instruction code in a memory;

dividing the master frequency into the plurality of secondary frequency values; and applying a correction logic function to the plurality of secondary frequency values to obtain a modified secondary frequency value.

10. An apparatus that performs frequency division, comprising:

means for specifying a plurality of secondary frequency values with a predetermined relationship;

means for creating an instruction code for dividing a master frequency into the plurality of secondary frequency values, the instruction code generating at least one basic divider value;

means for storing the instruction code in a memory; and means for dividing the master frequency into the plurality of secondary frequency values.

11. The apparatus of claim 10 wherein the specifying means includes means for specifying a plurality of tones to form a melody.

12. The apparatus of claim 10 wherein the specifying means includes means for specifying basic divide counts for the specified frequencies.

13. The apparatus of claim 12 further comprising means for performing multiplying/dividing operations for each of the basic divide counts.

14. The apparatus of claim 10 wherein the creating means includes means for creating a six-bit instruction code.

15. The apparatus of claim 10 wherein the creating means includes means for creating an instruction code for operating a dual-tone music box.

16. The apparatus of claim 10 wherein the creating means further includes means for selectively generating an operation on the basic divider value as a function of one of the specified secondary frequency values to be obtained.

17. The apparatus of claim 10 wherein the storing means includes means for storing the instruction code in a read-only memory.

18. The apparatus of claim 10 further comprising means for applying a correction logic function to at least one of the plurality of secondary frequency values to obtain a modified secondary frequency value.

19. A frequency dividing circuit, comprising:

memory means for storing an instruction code used to determine a secondary frequency value;

basic divider means for generating a basic divider value based on the instruction code;

operation select means for selecting an operation on the basic divider value based on the instruction code;

correction logic means for generating a correction logic value based on the instruction code and mathematically combining the correction logic value with the basic divider value and the operation on the basic divider value; and frequency divider means for dividing a master frequency into the secondary frequency value using the mathematical combination of the correction logic value, the basic divider value and the operation on the basic divider value.

20. The frequency dividing circuit of claim 19 wherein the memory means includes a read-only memory.

21. A method for performing frequency division comprising:

storing an instruction code used to determine a secondary frequency value;

generating a basic divider value based on the instruction code;

selecting an operation on the basic divider value based on the instruction code;

generating a correction logic value based on the instruction code and mathematically combining the correction logic value with the basic divider value and the operation on the basic divider value; and dividing a master frequency into the secondary frequency value using the mathematical combination of the correction logic value, the basic divider value and the operation on the basic divider value.

22. The method of claim 21, wherein the step of storing an instruction code includes the step of:

storing a six-bit instruction code.

23. The method of claim 21, wherein the step of storing an instruction code includes the step of:

storing the instruction code in a read-only memory.

* * * * *

UNITED STATES PATENT AND TRADEMARK OFFICE

CERTIFICATE OF CORRECTION

PATENT NO.: 6,140,569

DATED: October 31, 2000

INVENTOR(S): Tsai

It is certified that an error appears in the above-identified patent and that said Letters Patent is hereby corrected as shown below:

Claim 6, column 8, line 45, change "code:" to --code;--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*